United States Patent [19]

Morse et al.

[11] 4,058,206

[45] Nov. 15, 1977

[54] DISPLAY CARTON AND BLANK THEREFOR

[75] Inventors: Hugh B. Morse, San Jose; Robert B. Johnson, Santa Clara, both of Calif.

[73] Assignee: Helmut E. W. Masch, San Jose, Calif.

[21] Appl. No.: 706,889

[22] Filed: July 19, 1976

[51] Int. Cl.[2] ..... B65D 5/50; B65D 5/54

[52] U.S. Cl. ..... 206/44 R; 206/602; 206/622; 229/15

[58] Field of Search ..... 206/44 R, 44.12, 45.12, 206/491, 526-527; 229/15, 27, 42, 51 TS; 312/259

[56] References Cited

U.S. PATENT DOCUMENTS

| | | | |
|---|---|---|---|
| 2,937,742 | 5/1960 | Michiel | 206/44.12 |
| 3,494,498 | 2/1970 | Atherton | 229/15 X |
| 3,653,495 | 4/1972 | Gray | 206/44.12 X |
| 3,749,299 | 7/1973 | Ingle | 229/27 X |
| 3,884,410 | 5/1975 | Giesecke | 206/491 X |
| 3,917,158 | 11/1975 | Dorofachuk | 206/44 R X |

*Primary Examiner*—Steven E. Lipman
*Attorney, Agent, or Firm*—Phillips, Moore, Weissenberger, Lempio & Majestic

[57] ABSTRACT

A display carton comprises a one-piece blank cut and scored to form vertically disposed front, back and side panels and horizontally disposed top and bottom panels. A vertically disposed separate partition is further disposed intermediate the side panels and is attached to the front, back and bottom panels by lock tabs engaging accommodating slots formed through the panels. A continuous tear line is formed in the front, back, side, and top panels to divide the carton into a removable upper section and a lower section adapted to retain a plurality of upstanding packages therein for display purposes.

21 Claims, 6 Drawing Figures

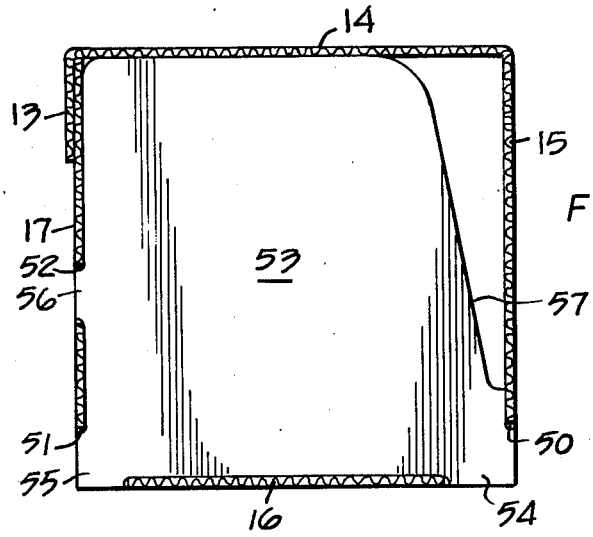
FIG. 5.
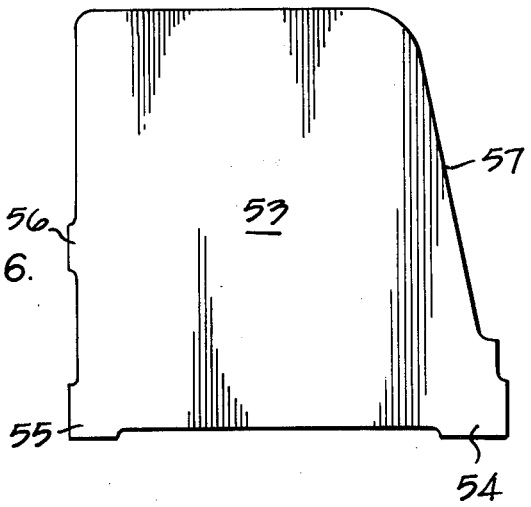
FIG. 6.
FIG. 4.
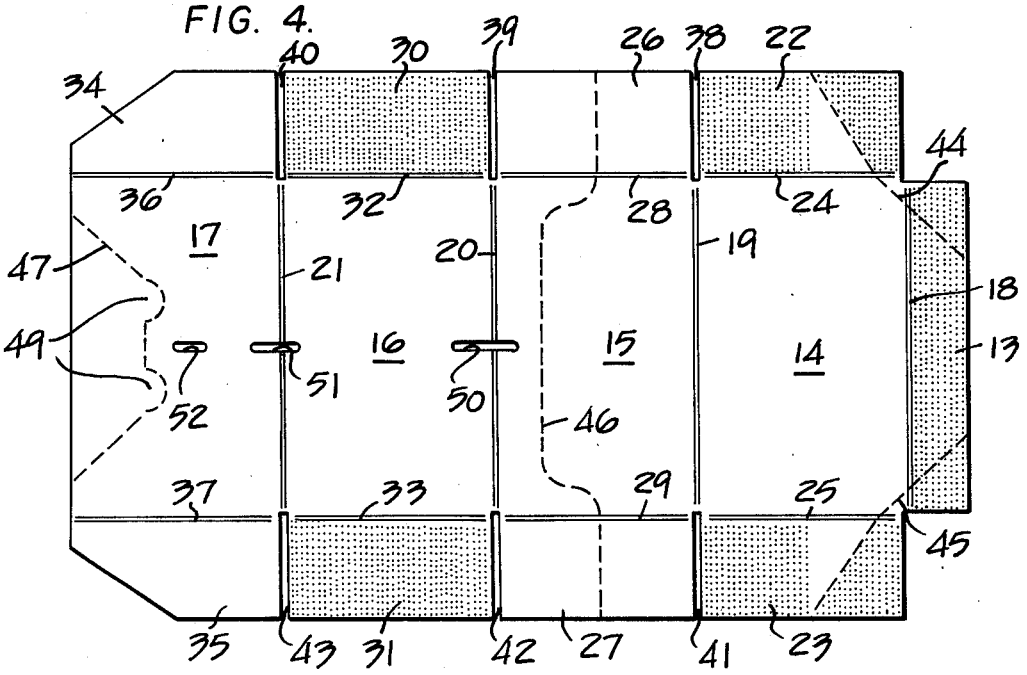

DISPLAY CARTON AND BLANK THEREFOR

BACKGROUND OF THE INVENTION

Conventional display cartons normally comprise a separable upper section which is torn away from the lower section thereof to expose packaged commodities, such as food stuffs. Such separation is normally effected by a tear strip or perforated tear line formed through panels of the carton. The carton is generally formed out of a one-piece blank which is suitably cut, scored and folded to retain the packaged commodities therein.

Continuous efforts have been made in the packaging industry to reduce the amount of paperboard used in cartons of this type. A five percent reduction of the amount of paperboard used in a carton, for example, can result in substantial monetary savings. In addition, it is desirable to provide a carton which can be formed expeditiously, exhibits a high degree of structural integrity and is adapted to be opened easily for the full display of packaged goods contained therein. These problems are particularly apparent with respect to display cartons wherein a central divider or partition is disposed therein.

SUMMARY OF THIS INVENTION

An object of this invention is to provide an economical display carton which will exhibit a high degree of structural integrity and is adapted to be erected and opened expeditiously. The carton comprises vertically disposed front, back, and side panels and horizontally disposed top and bottom panels, all connected together to define a removable upper section and a lower section. A continuous tear line is formed through at least some of the panels to facilitate removal of the upper section whereby packaged food stuffs or the like, retained in the lower section, may be fully displayed to the purchasing public. A vertically disposed and separate partition panel is further disposed between the side panels and is mechanically interlocked to at least the front and back panels to aid in increasing the overall structural rigidity of the carton and to aid in separating and retaining two rows of packages therein.

BRIEF DESCRIPTION OF THE DRAWINGS

Other objects of this invention will become apparent form the following description and accompanying drawings wherein;

FIG. 4 is a top plan view of a blank utilized to form of the carton illustrated in FIGS. 2 and 3;

FIG. 5 is a cross-sectional view through the carton, taken in the direction of arrows V—V in FIG. 2, to illustrate the disposition of a partition panel therein; and FIG. 6 is a side elevational view of the partition panel, shown removed from the carton

DETAILED DESCRIPTION

Figure 1:
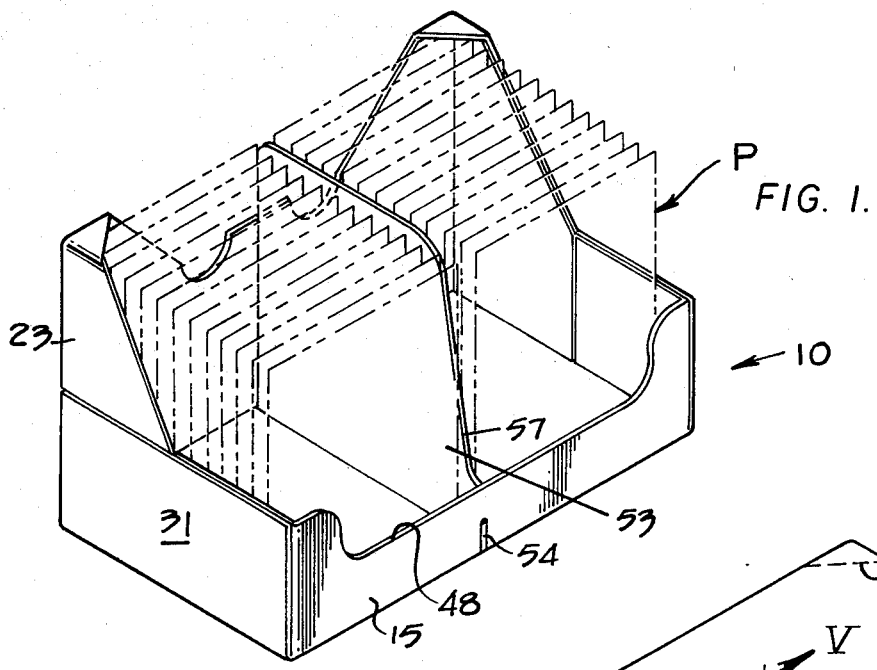
FIG. 1 is the front side isometric view of a display carton, shown in its opened condition to display a plurality of packages therein.
Figure 2:
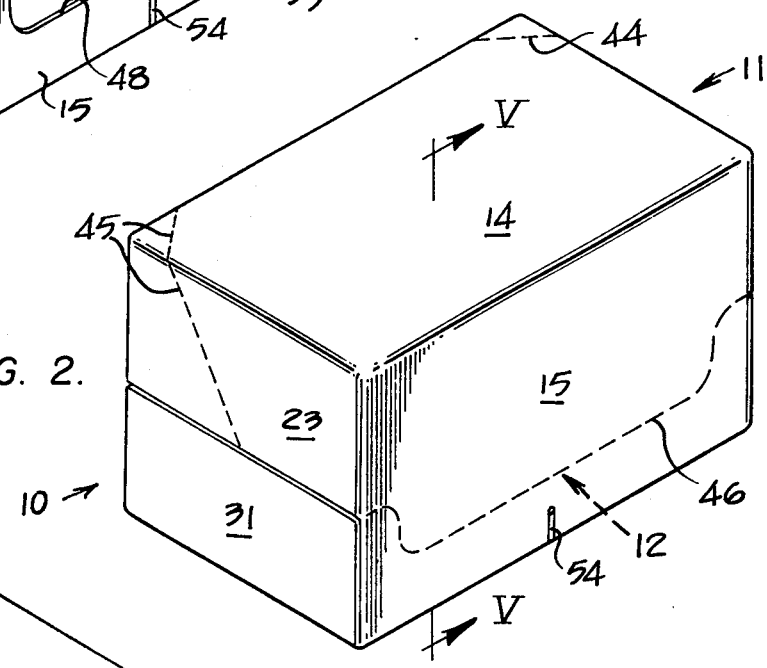
FIG. 2 is a view similar to FIG. 1, but showing the carton in its closed condition and prior to removal of an upper section therefrom.
Figure 3:
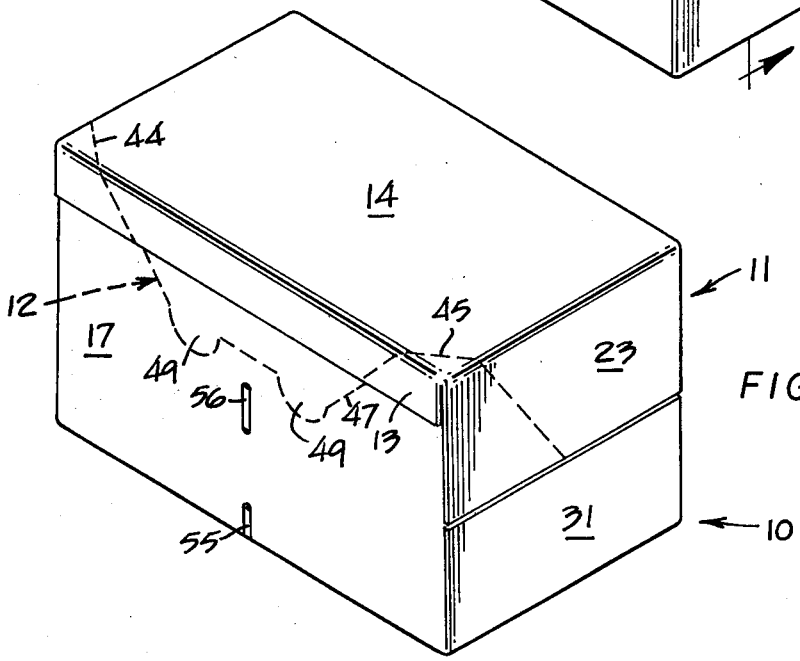
FIG. 3 is a back side isometric view of the carton, shown in its closed condition.

FIG. 1 illustrates a lower section 10 of a display carton adapted to retain a plurality of packages P in upstanding relationship therein. As shown in FIGS. 2 and 3, the erected carton originally comprises an upper section 11 detachably connected to the lower section by a continuous score line 12. Thus, when the closed display carton is delivered to a store, upper section 11 is removed from lower section 10 at tear line 12 to display packages P for consumer buying purposes.

FIG. 4 illustrates the inner side of a one-piece corrugated paperboard blank adapted to be folded and glued to form the closed carton illustrated in FIGS. 2 and 3. The blank consecutively comprises a manufacturer's glue flap 13, a top panel 14, and front panel 15, a bottom panel 16 and a back panel 17. Flap 13 is a hingedly connected to a rearward edge of top panel 14 by a scoreline 18 whereas a forward edge of the top panel is connected to an upper edge of front panel 15 by a scoreline 19.

A lower edge of the front panel is connected to a forward edge of bottom panel 16 by a scoreline 20 whereas a rearward edge of the bottom panel is connected to a lower edge of back panel 17 by a scoreline 21. It should be noted that scorelines 18-21 are disposed in parallel relationship relative to each other to adapt the carton blank for folding into its FIGS. 2 and 3 condition, as will be hereinafter explained. Top panel 14 has side flaps 22 and 23 hingedly connected to side edges thereof by scorelines 24 and 25, respectively.

Likewise, front panel 15 has side flaps 26 and 27 hingedly connected to side edges thereof by scorelines 28 and 29, respectively. Bottom panel 16 has side flaps 30 and 31 hingedly connected thereto by scorelines 32 and 33 whereas back panel 17 has side flaps 34 and 35 hingedly connected thereto by scorelines 36 and 37, respectively. It should be noted that slots 38–40 and 41–43 are formed at opposite ends of scorelines 19–21, respectively, to separate each adjacent pair of flaps to aid in the folding thereof. In addition, scorelines 24, 28, 32, and 36 as well as scorelines 25, 29, 33, and 37 are disposed in colinear relationship and in perpendicular relative to scorelines 19–21.

Tear line means 12 comprises a plurality of perforated tear lines 44–47 which have portions thereof superimposed over each other to form a continuous tear line means whereby upper section 11 of the carton (FIGS. 2 and 3) may be tornaway from lower section 10 thereof to form the opened display carton illustrated in FIG. 1. In particular, each tear line 44 and 45 terminates at an outer edge of a respective flap 22 or 23 and extends diagonally inwardly to cross scoreline 24 or 25 whereafter it diverges away therefrom to cross-over a corner of top panel 14 and extends through flap 13 to terminate at an outer edge thereof. Tear line 46 intersects a free edge of flap 26 and sequentially extends across scoreline 28, front panel 15, scoreline 29 and flap 27 to terminate at an outer edge thereof.

The intermediate portion of tear line 46, positioned within the front panel, is offset to provide a generally U-shaped cutout 48, as indicated in FIG. 1, which aids in exposing packages P and facilitates removal thereof from the carton. Scoreline 47 is generally V-shaped to terminate at its opposite ends at the outer edge of back panel 17 and converges inwardly towards bottom panel 16 to terminate at a pair of finger tabs 49. Such tabs facilitate insertion of a pair of fingers therethrough to remove upper section 11 of the carton for display purposes.

A first slot 50 is formed through front panel 15 and bottom panel 16 to intersect score line 20 which hingedly connects these panels together. A second slot 51 is formed through the bottom panel and back panel 17 in a like manner to intersect scoreline 21. A third slot 52 is formed through the back panel in colinear relationship relative to slots 50 and 51 and the slots are disposed intermediate the side edges of the carton blank.

Referring to FIGS. 5 and 6, the slots function to mechanically lock a partition and divider panel 53 within the carton. In particular, slots 50–52 are adapted to receive tabs 54–56 therein, respectively, with tabs 54 and 55 being formed at the lower corners of the partition panel and tab 56 being formed on a back edge thereof in vertically spaced relationship relative to tab 55. The partition panel fully extends between the top and bottom panels to thus increase the overall structural rigidity of the carton and also aid in maintaining packages P in their divided and viewable positions, as illustrated in FIG. 1. A tapered edge 57 is defined on a forward edge of the partition panel adjacent to the front panel to diverge upwardly away from the front panel towards the top panel.

As further shown in FIG. 4, a suitable adhesive, such as a standard glue, may be applied to flaps 13, 22, 23, 30 and 31 during formation of the carton on a straight-line gluer whereby it may be erected and glued together to assume its FIGS. 2 and 3 closed condition with partition panel 53 and packages P being disposed therein. In particular, flap 30 is secured to lower portions of underlying flaps 26 and 34 whereas corresponding flap 31 is secured to underlying flaps 27 and 35 in like manner. It should be noted that the upper edges of flaps 30 and 31 are concident with the portions of tear line 46 formed in flaps 26 and 27, respectively.

After insertion of packages P in the carton, flap 22 is secured to upper portions of flaps 26 and 34 whereas flap 23 is secured to upper portions of flaps 27 and 35 in a like manner. Each formed side panel of the carton will thus constitute a double-walled thickness to provide increased stacking strength and structural rigidity to the carton. Manufacturer's glue flap 13 is thereafter secured to an upper edge of back panel 17 whereby the carton is adapted for shipping to a market or the like.

We claim:

1. A display carton comprising
vertically disposed front and back panels,
a vertically disposed pair of side panels connected to said front and back panels,
horizontally disposed top and bottom panels each connected to said front, back and side panels,
a vertically disposed separate partition panel disposed in said carton between said side panels and extending between said front and back panels to define an unobstructed receptacle on each side of said partition panel,
means releasably locked said partition panel to at least said front and back panels comprising at least one lock tab formed on opposite ends of said partition panel and engaged within a slot formed in a respective one of said front and back panels and in said bottom panel, said slot extending across a common scoreline connecting said bottom panel to a respective one of said front and back panels; and
means defining a continuous tear line through at least some of said front, back, side and top panels for dividing said carton into a removable upper section and a lower section adapted to retain a plurality of packages on either side of said partition panel in said lower section.

2. The display carton of claim 1 further comprising a flap connected to an edge of said top panel, said flap secured to an upper end of said back panel.

3. The display carton of claim 2 further comprising a pair of side flaps connected to lateral sides of each of said front, back, side and top panels, the flaps exposed on each side of said display carton secured together in side panels.

4. The display carton of claim 3 wherein the flaps secured to each of said top and bottom panels are superimposed over the flaps connected to each of said front and back panels.

5. The display carton of claim 4 further comprising a slot defined between each adjacent pair of flaps on each side of said carton.

6. The display carton of claim 3 wherein said means defining a continuous tear line comprises a first tear line formed at least in the first side flap connected to said top panel and in the flap connected to a forward edge of said top panel, a second tear line formed in the other side flap connected to said top panel and in the flap connected to a forward edge of said side panel, a third tear line formed in said front panel and in the side flaps connected thereto and a fourth tear line formed in said back panel.

7. The display carton of claim 6 wherein each of said first and second tear lines is disposed between and intersects opposite ends of said third and fourth tear lines.

8. The display carton of claim 6 wherein each of said first and second tear lines is also formed in said top panel.

9. The display carton of claim 1 wherein said flap, said top panel, said front panel, said bottom panel and said back panel are consecutively connected together at common scorelines.

10. The display carton of claim 1 wherein said partition panel is flat and has a constant thickness throughout its length and extends fully vertically between said top and bottom panels.

11. The display carton of claim 10 wherein a bottom portion of said partition panel extends fully between said front and back panels and means defining a tapered edge on a forward edge of said partition panel adjacent to said front panel which diverges upwardly away from said front panel towards said top panel.

12. The display carton of claim 1 wherein a said lock tab is formed at each lower corner of said partition panel, said lock tabs engaging slots formed through said front panel and said bottom panel and through said back panel and said bottom panel, respectively.

13. The display carton of claim 12 further comprising a third lock tab formed on a rearward edge of said partition panel in vertically spaced relationship relative to one of said other lock tabs and engaged within a slot formed through said back panel.

14. A display carton comprising
vertically disposed front and back panels,
a vertically disposed pair of side panels connected to said front and back panels,
horizontally disposed top and bottom panels each connected to said front, back and side panels,
a vertically disposed separate partition panel disposed in said carton between said side panels,
means locking said partition panel to at least said front and back panels,
means defining a continous tear line through at least some of said front, back, side and top panels for dividing said carton into a removable upper section and a lower section adapted to retain a plurality of packages on either side of said partition panel in said lower section, a flap connected to an edge of said top panel, said flap secured to an upper end of said back panel, and a pair of side flaps connected to lateral sides of each of said front, back, side and top panels, the flaps exposed on each side of said display carton secured together in superimposed relationship to form a respective one of said side panels, said means defining a continuous tear line comprising a first tear line formed at least in the first side flap connected to said top panel and in the flap connected to a forward edge of said top panel, a second tear line formed in the other side flap connected to said top panel and in the flap connected to a forward edge of said side panel, a third tear line formed in said front panel and in the side flaps connected thereto and a fourth tear line formed in said back panel.

15. A blank cut and scored to consecutively define a rectangular top panel, a rectangular front panel, a rectangular bottom panel sized identically with said top panel, a rectangular back panel sized identically with said front panel, means defining a plurality of slots through at least some of said panels and disposed in colinear relationship thereon for adaption to receive lock tabs of a partition panel therein, means defining separate tear lines in at least some of said panels for forming a continous tear line upon erection of said blank into a display carton for separating said display carton into a removable upper section and a lower section adapted to retain a plurality of packages therein, a flap connected to an edge of said top panel and being substantially coextensive therewith, a pair of side flaps connected on lateral sides of each of said top, front, bottom, and back panels, and wherein said means defining separate tear lines comprises a first tear line formed in one of the side flaps connected to said top panel, said top panel and the flap connected to a forward edge of said top panel, a second tear line formed in the second side flap connected to said top panel, said top panel and the flap connected to the forward edge of said top panel, and a third tear line formed in the side flaps connected to said front panel and said front panel and a fourth tear line formed solely in said back panel.

16. The carton blank of claim 15 wherein a scoreline hingedly connects said top panel to said front panel, said front panel to said bottom panel and said bottom panel to said back panel and further comprising a slot defined through each pair of adjacent flaps connected to a respective side of said carton blank with each of said slots being disposed in colinear relationship with respect to one of said scorelines.

17. The carton blank of claim 15 wherein said slots comprise a first slot formed through said front and bottom panels and a second slot formed through said bottom and back panels, said slots disposed substantially intermediate opposite sides of said carton blank.

18. The carton blank of claim 17 further comprising a third slot formed through said back panel and spaced apart from said second slot.

19. The carton blank of claim 15 wherein said fourth tear line is generally V-shaped to converge from an edge of said back panel towards said bottom panel.

20. The carton blank of claim 15 wherein said third tear line comprises an intermediate portion formed solely in said front panel in offset relationship relative to the remaining portions of said third tear line to define a cut-out in said front panel upon tearing of said third tear line.

21. The carton blank of claim 20 wherein said fourth tear line terminates at a pair of spaced finger tabs defined thereby.

* * * * *